US007825921B2

(12) United States Patent
Han et al.

(10) Patent No.: US 7,825,921 B2
(45) Date of Patent: Nov. 2, 2010

(54) SYSTEM AND METHOD FOR IMPROVING SUB-PIXEL RENDERING OF IMAGE DATA IN NON-STRIPED DISPLAY SYSTEMS

(75) Inventors: Seok Jin Han, Cupertino, CA (US); Bai-Shuh Hsu, Newark, CA (US); Moon Hwan Im, Cupertino, CA (US)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 908 days.

(21) Appl. No.: 10/821,387

(22) Filed: Apr. 9, 2004

(65) Prior Publication Data

US 2005/0225548 A1 Oct. 13, 2005

(51) Int. Cl.
*G09G 5/00* (2006.01)

(52) U.S. Cl. ..... 345/213; 345/698

(58) Field of Classification Search ..... 345/88, 345/32, 213, 690, 600, 204, 698, 501; 382/260; 348/540

See application file for complete search history.

(56) References Cited

U.S. PATENT DOCUMENTS 5,010,413 A 4/1991 Bahr
5,062,057 A 10/1991 Blacken et al.
5,113,274 A 5/1992 Takahashi et al.
5,341,153 A 8/1994 Benzschawel et al.
5,398,066 A 3/1995 Martinez-Uriegas et al.
6,160,535 A * 12/2000 Park ..... 345/88
6,243,055 B1 * 6/2001 Fergason ..... 345/32
6,278,434 B1 8/2001 Hill et al.
6,340,970 B1 * 1/2002 Furuhashi et al. ..... 345/213
6,360,023 B1 3/2002 Betrisey et al.
6,393,145 B2 5/2002 Betrisey et al.
6,414,719 B1 7/2002 Parikh
6,614,414 B2 9/2003 De Haan et al.
6,738,526 B1 5/2004 Betrisey et al.
6,937,217 B2 8/2005 Klompenhouwer et al.
7,046,256 B2 * 5/2006 Credelle ..... 345/613
7,068,287 B2 6/2006 Credelle
7,084,923 B2 8/2006 Brown Elliott et al.
7,170,505 B2 * 1/2007 Akahori ..... 345/204

(Continued)

FOREIGN PATENT DOCUMENTS

CN 1354452 A 6/2002
WO WO 00/42762 7/2000

OTHER PUBLICATIONS

Betrisey, C., et al., Displaced Filtering for Patterned Displays, SID Symp. Digest 1999, pp. 296-299.

(Continued)

*Primary Examiner*—Amare Mengistu
*Assistant Examiner*—Yuk Chow
(74) *Attorney, Agent, or Firm*—Innovation Counsel LLP

(57) ABSTRACT

The present application discloses a number of embodiments for the mapping of input image data onto display panels in which the subpixel data format being input may differ from the subpixel data format suitable for the display panel. Systems and methods are disclosed to map input image data onto panels with different ordering of subpixel data that the input, different number of subpixel data sets or different number of color primaries that the input image data.

4 Claims, 18 Drawing Sheets

U.S. PATENT DOCUMENTS

| | | | | |
|---|---|---|---|---|
| 2001/0048764 | A1 | 12/2001 | Betrisey et al. | |
| 2002/0047923 | A1* | 4/2002 | Okuno et al. | 348/540 |
| 2002/0093521 | A1* | 7/2002 | Daly et al. | 345/698 |
| 2003/0006978 | A1 | 1/2003 | Fujiyoshi | |
| 2003/0034992 | A1* | 2/2003 | Brown Elliott et al. | 345/690 |
| 2003/0052886 | A1* | 3/2003 | Naegle | 345/501 |
| 2004/0140983 | A1 | 7/2004 | Credelle | |
| 2004/0169807 | A1* | 9/2004 | Rho et al. | 349/139 |
| 2004/0239813 | A1 | 12/2004 | Klompenhouwer | |
| 2004/0263528 | A1* | 12/2004 | Murdoch et al. | 345/600 |
| 2005/0099540 | A1 | 5/2005 | Elliott et al. | |
| 2005/0169551 | A1* | 8/2005 | Messing et al. | 382/260 |
| 2006/0061605 | A1 | 3/2006 | Credelle | |
| 2006/0238649 | A1 | 10/2006 | Brown Elliott et al. | |

OTHER PUBLICATIONS

Brown Elliott, C., "Active Matrix Display . . . ", IDMC 2000, 185-189, Aug. 2000.
Brown Elliott, C., "Color Subpixel Rendering Projectors and Flat Panel Displays," SMPTE, Feb. 27-Mar. 1, 2003, Seattle, WA pp. 1-4.
Brown Elliott, C, "Co-Optimization of Color AMLCD Subpixel Architecture and Rendering Algorithms," SID 2002 Proceedings Paper, May 30, 2002 pp. 172-175.
Brown Elliott, C, "Development of the PenTile Matrix™ Color AMLCD Subpixel Architecture and Rendering Algorithms", SID 2003, Journal Article.
Brown Elliott, C, "New Pixel Layout for PenTile Matrix™ Architecture", IDMC 2002, pp. 115-117.
Brown Elliott, C, "Reducing Pixel Count Without Reducing Image Quality", Information Display Dec. 1999, vol. 1, pp. 22-25.
Credelle, Thomas, "P-00: MTF of High-Resolution PenTile Matrix Displays", Eurodisplay 02 Digest, 2002 pp. 1-4.
Klompenhouwer, Michiel, Subpixel Image Scaling for Color Matrix Displays, SID Symp. Digest, May 2002, pp. 176-179.
Michiel A. Klompenhouwer, Gerard de Haan, Subpixel image scaling for color matrix displays, Journal of the Society for Information Display, vol. 11, Issue 1, Mar. 2003, pp. 99-108.
Messing, Dean et al., Improved Display Resolution of Subsampled Colour Images Using Subpixel Addressing, IEEE ICIP 2002, vol. 1, pp. 625-628.
Messing, Dean et al., Subpixel Rendering on Non-Striped Colour Matrix Displays, 2003 International Conf on Image Processing, Sep. 2003, Barcelona, Spain, 4 pages.
PCT International Search Report dated Jul. 29, 2004 for PCT/US04/00827 (U.S. Appl. No. 10/349,768).
PCT International Search Report dated Mar. 11, 2005 for PCT/US05/010022 (US Patent No. 7,084,023).
USPTO, Non-Final Office Action, dated Jun. 16, 2004 in US Patent No. 7,046,256 (U.S. Appl. No. 10/349,768).
Clairvoyante Inc, Response to Non-Final Office Action, dated Sep. 10, 2004 in US Patent No. 7,046,256 (U.S. Appl. No. 10/349,768).
USPTO, Non-Final Office Action, dated Jan. 25, 2005 in US Patent No. 7,046,256 (U.S. Appl. No. 10/349,768).
Clairvoyante Inc, Response to Non-Final Office Action, dated Jul. 8, 2005 in US Patent No. 7,046,256 (U.S. Appl. No. 10/349,768).
USPTO, Notice of Allowance, dated Oct. 5, 2005 in US Patent No. 7,046,256 (U.S. Appl. No. 10/349,768).
USPTO, Notice of Allowance, dated Feb. 9, 2006 in US Patent No. 7,068,287 (U.S. Appl. No. 11/273,965).
USPTO, Non-Final Office Action dated Apr. 7, 2005 in US Patent No. 7,084,923 (U.S. Appl. No. 10/696,235).
Clairvoyante Inc, Response to Non-Final Office Action dated Aug. 30, 2005 in US Patent No. 7,084,923 (U.S. Appl. No. 10/696,235).
USPTO, Final Office Action dated Jan. 29, 2008 in US Patent Publication No. 2006/0238649 (U.S. Appl. No. 11/427,254).

* cited by examiner

| | | | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|---|
| R 00 | G 00 | B 00 | G 01 | R 01 | G 01 | B 10 | G 10 | R 10 | G 11 | B 11 | G 11 | R 00 | G 00 | B 00 | G 01 | ..... | R 00 | G 00 | B 00 | G 01 | R 01 | G 01 | B 10 | G 10 | R 10 | G 11 | B 11 | G 11 | R 00 | G 00 | B 00 | G 11 |
| B 11 | G 11 | R 00 | G 00 | B 00 | G 01 | R 01 | G 01 | B 10 | G 10 | R 10 | G 11 | B 11 | G 11 | R 00 | G 00 | ..... | B 11 | G 11 | R 00 | G 00 | B 00 | G 01 | R 01 | G 01 | B 10 | G 10 | R 10 | G 11 | B 11 | G 11 | R X | G X |
| R X | G 11 | B 11 | G 11 | R 00 | G 00 | B 00 | G 01 | R 01 | G 01 | B 10 | G 10 | R 10 | G 11 | B 11 | G 11 | ..... | R 10 | G 11 | B 11 | G 11 | R 00 | G 00 | B 00 | G 01 | R 01 | G 01 | B 10 | G 10 | R 10 | G 11 | B 11 | G 11 |
| B 10 | G 10 | R 10 | G 11 | B 11 | G 11 | R 00 | G 00 | B 00 | G 01 | R 01 | G 01 | B 10 | G 10 | R 10 | G 11 | ..... | B 10 | G 10 | R 10 | G 11 | B 11 | G 11 | R 00 | G 00 | B 00 | G 01 | R 01 | G 01 | B 10 | G 10 | R 10 | G 01 |
| R 01 | G 01 | B 10 | G 10 | R 10 | G 11 | B 11 | G 11 | R 00 | G 00 | B 00 | G 01 | R 01 | G 01 | B 10 | G 10 | ..... | R 01 | G 01 | B 10 | G 10 | R 10 | G 11 | B 11 | G 11 | R 00 | G 00 | B 00 | G 01 | R 01 | G 01 | B Y | G Y |
| B Y | G 01 | R 01 | G 01 | B 10 | G 10 | R 10 | G 11 | B 11 | G 11 | R 00 | G 00 | B 00 | G 01 | R 01 | G 01 | ..... | B 00 | G 01 | R 01 | G 01 | B 10 | G 10 | R 10 | G 11 | B 11 | G 11 | R 00 | G 00 | B 00 | G 01 | R 01 | G 01 |
| R | G | B | G | R | G | B | G | R | G | B | G | R | G | B | G | ..... | R | G | B | G | R | G | B | G | R | G | B | G | R | G | B | G |
| B | G | R | G | B | G | R | G | B | G | R | G | B | G | R | G | ..... | B | G | R | G | B | G | R | G | B | G | R | G | B | G | R | G |
| R | G | B | G | R | G | B | G | R | G | B | G | R | G | B | G | ..... | R | G | B | G | R | G | B | G | R | G | B | G | R | G | B | G |
| B | G | R | G | B | G | R | G | B | G | R | G | B | G | R | G | ..... | B | G | R | G | B | G | R | G | B | G | R | G | B | G | R | G |
| R | G | B | G | R | G | B | G | R | G | B | G | R | G | B | G | ..... | R | G | B | G | R | G | B | G | R | G | B | G | R | G | B | G |
| B | G | R | G | B | G | R | G | B | G | R | G | B | G | R | G | ..... | B | G | R | G | B | G | R | G | B | G | R | G | B | G | R | G |
| ..... | | | | | | | | | | | | | | | | | | | | | | | | | | | | | | | | | |

FIG. 17

Interface Formats

Frame-buffer interface format

FIG. 22

| EXEMPLARY REPEATER GROUP | | 2-CHANNEL | | 3-CHANNEL | | | | 4-CHANNEL | |
|---|---|---|---|---|---|---|---|---|---|
| | | EVEN LINE | ODD LINE | EVEN LINE | ODD LINE | EVEN LINE | ODD LINE | EVEN LINE | ODD LINE |
| R B G<br>G B R | 1ST CHANNEL | | | R | G | | | | |
| | 2ND CHANNEL | | | B | B | | | | |
| | 3RD CHANNEL | | | G | R | | | | |
| | 4TH CHANNEL | | | | | | | | |
| R B G B<br>G B R B | 1ST CHANNEL | | | R | G | | | | |
| | 2ND CHANNEL | | | B | B | | | | |
| | 3RD CHANNEL | | | G | R | | | | |
| | 4TH CHANNEL | | | | | | | | |
| R G B G<br>B G R G | 1ST CHANNEL | R, B | B, R | R,G,B,G | B,G,R,G | R,X,R,X | B,X,B,X | R | B |
| | 2ND CHANNEL | G, G | G, G | G,R,G,B | G,B,G,R | G,G,G,G | G,G,G,G | G | G |
| | 3RD CHANNEL | | | B,G,R,G | R,G,B,G | B,X,B,X | R,X,R,X | B | R |
| | 4TH CHANNEL | | | | | | | G | G |
| R B G<br>G W R | 1ST CHANNEL | | | R | G | R | G | | |
| | 2ND CHANNEL | | | B | W | W | B | | |
| | 3RD CHANNEL | | | G | R | G | R | | |
| | 4TH CHANNEL | | | | | | | | |
| R B G W<br>G W R B | 1ST CHANNEL | | | R,W | G,B | | | R | G |
| | 2ND CHANNEL | | | B,R | W,G | | | B | W |
| | 3RD CHANNEL | | | G,B | R,W | | | G | R |
| | 4TH CHANNEL | | | | | | | W | B |

SYSTEM AND METHOD FOR IMPROVING SUB-PIXEL RENDERING OF IMAGE DATA IN NON-STRIPED DISPLAY SYSTEMS

BACKGROUND

In commonly owned United States Patent Applications: (1) U.S. patent application Ser. No. 09/916,232 ("the '232 application"), entitled "ARRANGEMENT OF COLOR PIXELS FOR FULL COLOR IMAGING DEVICES WITH SIMPLIFIED ADDRESSING," filed Jul. 25, 2001; (2) U.S. patent application Ser. No. 10/278,353 ("the '353 application"), entitled "IMPROVEMENTS TO COLOR FLAT PANEL DISPLAY SUB-PIXEL ARRANGEMENTS AND LAYOUTS FOR SUB-PIXEL RENDERING WITH INCREASED MODULATION TRANSFER FUNCTION RESPONSE," filed Oct. 22, 2002; (3) U.S. patent application Ser. No. 10/278,352 ("the '352 application"), entitled "IMPROVEMENTS TO COLOR FLAT PANEL DISPLAY SUB-PIXEL ARRANGEMENTS AND LAYOUTS FOR SUB-PIXEL RENDERING WITH SPLIT BLUE SUB-PIXELS," filed Oct. 22, 2002; (4) U.S. patent application Ser. No. 10/243,094 ("the '094 application), entitled "IMPROVED FOUR COLOR ARRANGEMENTS AND EMITTERS FOR SUB-PIXEL RENDERING," filed Sep. 13, 2002; (5) U.S. patent application Ser. No. 10/278,328 ("the '328 application"), entitled "IMPROVEMENTS TO COLOR FLAT PANEL DISPLAY SUB-PIXEL ARRANGEMENTS AND LAYOUTS WITH REDUCED BLUE LUMINANCE WELL VISIBILITY," filed Oct. 22, 2002; (6) U.S. patent application Ser. No. 10/278,393 ("the '393 application"), entitled "COLOR DISPLAY HAVING HORIZONTAL SUB-PIXEL ARRANGEMENTS AND LAYOUTS," filed Oct. 22, 2002; (7) U.S. patent application Ser. No. 01/347,001 ("the '001 application") entitled "IMPROVED SUB-PIXEL ARRANGEMENTS FOR STRIPED DISPLAYS AND METHODS AND SYSTEMS FOR SUB-PIXEL RENDERING SAME," filed Jan. 16, 2003, each of which is herein incorporated by reference in its entirety, novel sub-pixel arrangements are disclosed for improving the cost/performance curves for image display devices.

For certain subpixel repeating groups having an even number of subpixels in a horizontal direction, the following systems and techniques to affect improvements, e.g. proper dot inversion schemes and other improvements, are disclosed and are herein incorporated by reference in their entirety: (1) U.S. patent application Ser. No. 10/456,839 entitled "IMAGE DEGRADATION CORRECTION IN NOVEL LIQUID CRYSTAL DISPLAYS"; (2) U.S. patent application Ser. No. 10/455,925 entitled "DISPLAY PANEL HAVING CROSS-OVER CONNECTIONS EFFECTING DOT INVERSION"; (3) U.S. patent application Ser. No. 10/455,931 entitled "SYSTEM AND METHOD OF PERFORMING DOT INVERSION WITH STANDARD DRIVERS AND BACKPLANE ON NOVEL DISPLAY PANEL LAYOUTS"; (4) U.S. patent application Ser. No. 10/455,927 entitled "SYSTEM AND METHOD FOR COMPENSATING FOR VISUAL EFFECTS UPON PANELS HAVING FIXED PATTERN NOISE WITH REDUCED QUANTIZATION ERROR"; (5) U.S. patent application Ser. No. 10/456,806 entitled "DOT INVERSION ON NOVEL DISPLAY PANEL LAYOUTS WITH EXTRA DRIVERS"; (6) U.S. patent application Ser. No. 10/456,838 entitled "LIQUID CRYSTAL DISPLAY BACKPLANE LAYOUTS AND ADDRESSING FOR NON-STANDARD SUBPIXEL ARRANGEMENTS"; (7) U.S. patent application Ser. No. 10/696,236 entitled "IMAGE DEGRADATION CORRECTION IN NOVEL LIQUID CRYSTAL DISPLAYS WITH SPLIT BLUE SUBPIXELS", filed Oct. 28, 2003; and (8) U.S. patent application Ser. No. 10/807,604 entitled "IMPROVED TRANSISTOR BACKPLANES FOR LIQUID CRYSTAL DISPLAYS COMPRISING DIFFERENT SIZED SUBPIXELS", filed Mar. 23, 2004.

These improvements are particularly pronounced when coupled with sub-pixel rendering (SPR) systems and methods further disclosed in those applications and in commonly owned United States Patent Applications: (1) U.S. patent application Ser. No. 10/051,612 ("the '612 application"), entitled "CONVERSION OF RGB PIXEL FORMAT DATA TO PENTILE MATRIX SUB-PIXEL DATA FORMAT," filed Jan. 16, 2002; (2) U.S. patent application Ser. No. 10/150,355 ("the '355 application"), entitled "METHODS AND SYSTEMS FOR SUB-PIXEL RENDERING WITH GAMMA ADJUSTMENT," filed May 17, 2002; (3) U.S. patent application Ser. No. 10/215,843 ("the '843 application"), entitled "METHODS AND SYSTEMS FOR SUB-PIXEL RENDERING WITH ADAPTIVE FILTERING," filed Aug. 8, 2002; (4) U.S. patent application Ser. No. 10/379,767 entitled "SYSTEMS AND METHODS FOR TEMPORAL SUB-PIXEL RENDERING OF IMAGE DATA" filed Mar 4, 2003; (5)U.S. patent application Ser. No. 10/379,765 entitled "SYSTEMS AND METHODS FOR MOTION ADAPTIVE FILTERING," filed Mar. 4, 2003; (6) U.S. patent application Ser. No. 10/379,766 entitled "SUB-PIXEL RENDERING SYSTEM AND METHOD FOR IMPROVED DISPLAY VIEWING ANGLES" filed Mar. 4, 2003; (7) U.S. patent application Ser. No. 10/409,413 entitled "IMAGE DATA SET WITH EMBEDDED PRE-SUBPIXEL RENDERED IMAGE" filed Apr. 7, 2003, which are hereby incorporated herein by reference in their entirety.

Improvements in gamut conversion and mapping are disclosed in commonly owned and co-pending United States Patent Applications: (1) U.S. patent application Ser. No. 10/691,200 entitled "HUE ANGLE CALCULATION SYSTEM AND METHODS", filed Oct. 21, 2003; (2) U.S. patent application Ser. No. 10/691,377 entitled "METHOD AND APPARATUS FOR CONVERTING FROM SOURCE COLOR SPACE TO RGBW TARGET COLOR SPACE", filed Oct. 21, 2003; (3) U.S. patent application Ser. No. 10/691,396 entitled "METHOD AND APPARATUS FOR CONVERTING FROM A SOURCE COLOR SPACE TO A TARGET COLOR SPACE", filed Oct. 21, 2003; and (4) U.S. patent application Ser. No. 10/690,716 entitled "GAMUT CONVERSION SYSTEM AND METHODS" filed Oct. 21, 2003 which are all hereby incorporated herein by reference in their entirety.

Additional advantages have been described in (1) U.S. patent application Ser. No. 10/696,235 entitled "DISPLAY SYSTEM HAVING IMPROVED MULTIPLE MODES FOR DISPLAYING IMAGE DATA FROM MULTIPLE INPUT SOURCE FORMATS", filed Oct. 28, 2003 and (2) U.S. patent application Ser. No. 10/696,026 entitled "SYSTEM AND METHOD FOR PERFORMING IMAGE RECONSTRUCTION AND SUBPIXEL RENDERING TO EFFECT SCALING FOR MULTI-MODE DISPLAY" filed Oct. 28, 2003.

Additionally, these co-owned and co-pending applications are herein incorporated by reference in their entirety: (1) U.S. patent application Ser. No. 11/873,221 entitled "SYSTEMS AND METHODS FOR SELECTING A WHITE POINT FOR IMAGE DISPLAYS"; (2) U.S. patent application Ser. No. 10/821,353 entitled "NOVEL SUBPIXEL LAYOUTS AND ARRANGEMENTS FOR HIGH BRIGHTNESS DISPLAYS"; (3) U.S. patent application Ser. No. 10/821,306 entitled "SYSTEMS AND METHODS FOR IMPROVED GAMUT MAPPING FROM ONE IMAGE DATA SET TO ANOTHER"; (4) U.S. patent application Ser. No. 11/780,898 entitled "IMPROVED SUBPIXEL RENDERING FILTERS FOR HIGH BRIGHTNESS SUBPIXEL LAYOUTS"; which are all hereby incorporated by reference. All patent applications mentioned in this specification are hereby incorporated by reference in their entirety.

BRIEF DESCRIPTION OF THE DRAWINGS

The accompanying drawings, which are incorporated in, and constitute a part of this specification illustrate exemplary implementations and embodiments of the invention and, together with the description, serve to explain principles of the invention.

FIG. 17 is one example of an output pattern sequence.

FIG. 22 is another example of a the interface formats that might be implemented for a variety of layouts and data formats.

DETAILED DESCRIPTION

Reference will now be made in detail to implementations and embodiments, examples of which are illustrated in the accompanying drawings. Wherever possible, the same reference numbers will be used throughout the drawings to refer to the same or like parts.

Figure 1:
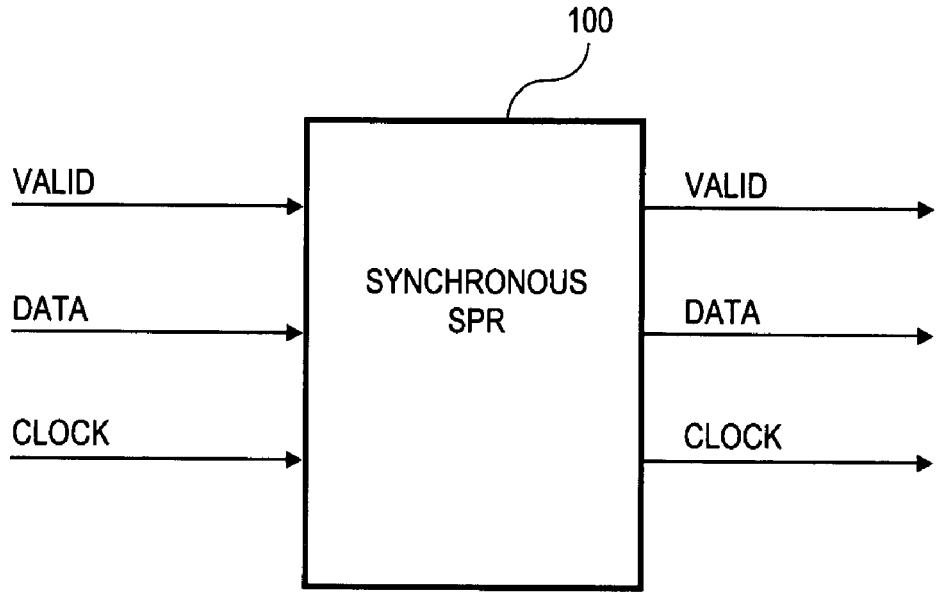
FIG. 1 is a block diagram of a video interface with synchronous SPR processing.
Figure 2:
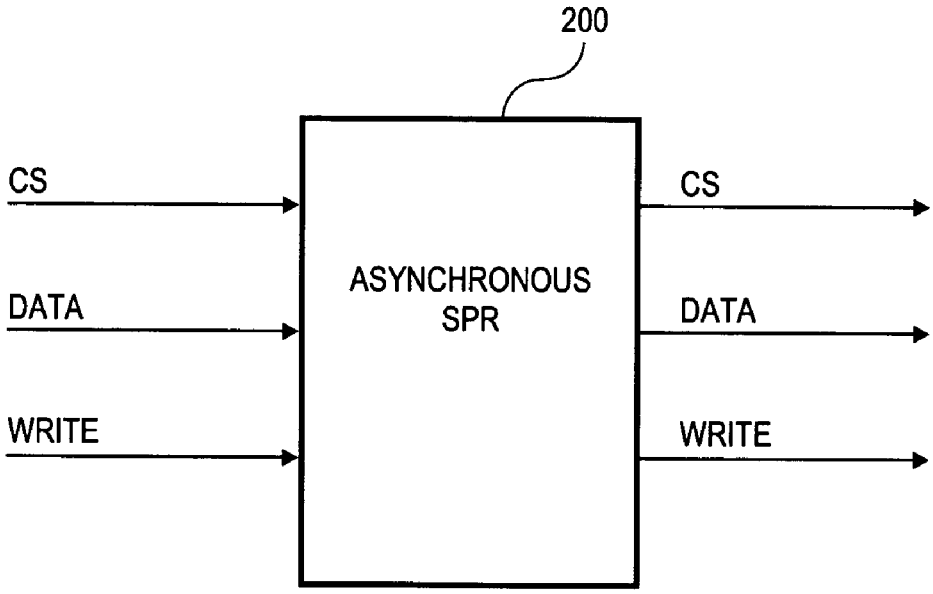
FIG. 2 is a block diagram of a MPU interface with asynchronous SPR processing.

FIGS. 1 and 2 show very high level, block diagrams of two embodiments of implementing sub-pixel rendering (SPR) on input image data. FIG. 1 shows one embodiment in which SPR block 100 comprises synchronous logic processing. Possible input into SPR block 100 might be a Valid signal, a Data signal and a Clock signal. Signals corresponding to these may be also output by SPR block 100—after block 100 has effected the desired changes in the image data via SPR and/or gamma or other processing. FIG. 2 shows one embodiment in which SPR block 102 comprises asynchronous logic processing. Possible input into SPR block 102 might be a CS signal, Data signal and a Write signal. These signals may also be mirrored in the output of block 102—after appropriate processing occurs. There are various applications and interfaces that FIGS. 1 and 2 might be implemented. For example, FIG. 1 may be suited for a video interface (possibly having Hsync and Vsync signals) and FIG. 2 might be suited to a Microprocessing Unit (MPU) interface (which is typically asynchronous).

Figure 3:
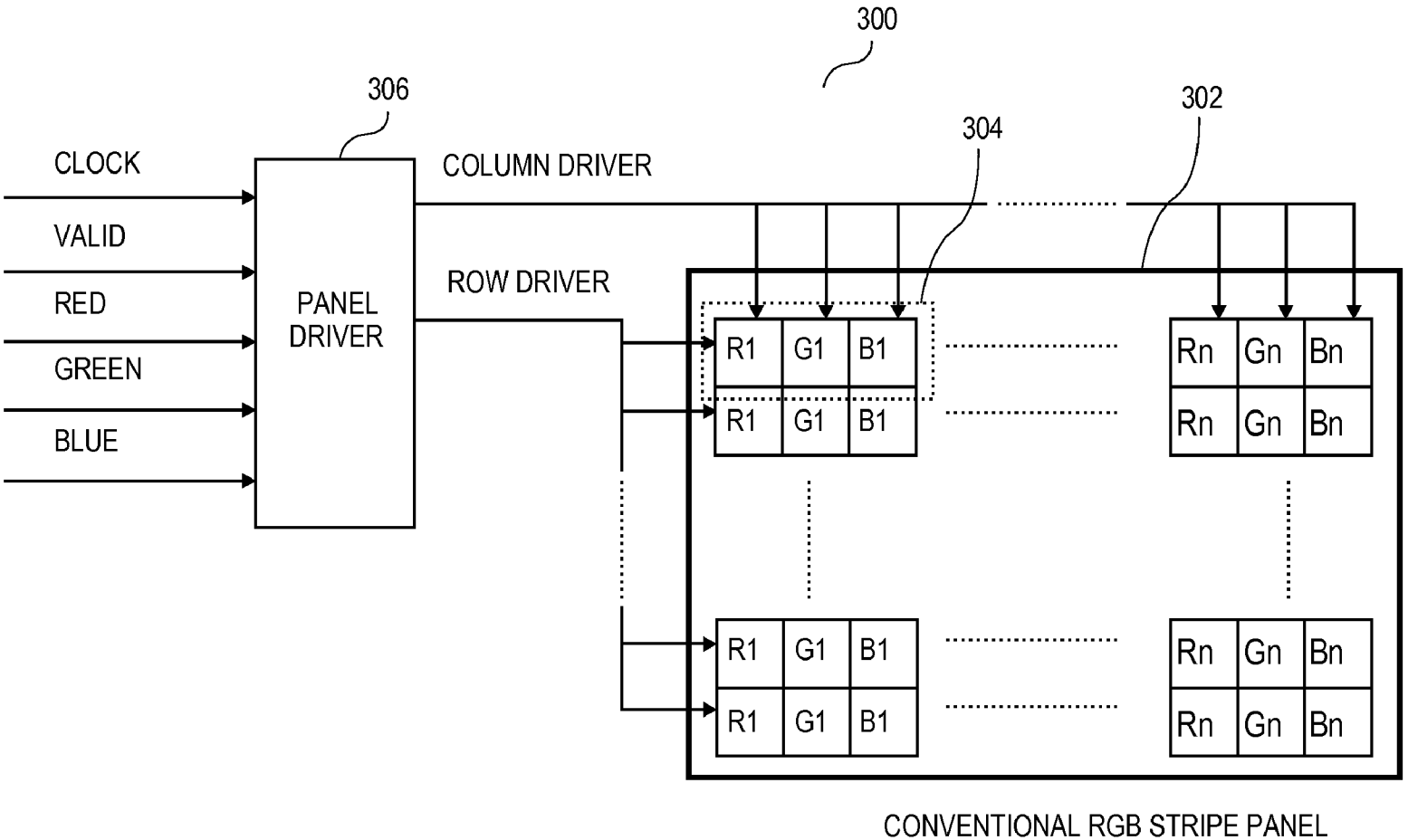
FIG. 3 (PRIOR ART)
FIG. 3 is a block diagram of video processing for a conventional RGB stripe display system.

FIG. 3 depicts a conventional display system 300 having a typical RGB striped display 302 with a three subpixel repeating pattern 304 comprising a red subpixel, a green subpixel and a blue subpixel. As may be seen, display 302 is driven by a panel driver 306 that accepts a plurality of signals (e.g. clock, valid, red data, green data and blue data) and outputs data and control signals via column drivers and row drivers respectively. As shown, the image data is written to the screen a row at time—in the manner of R1, G1, B1, R2, G2, B2 . . . Rn, Gn, Bn, where n is the number of pixels in the horizontal direction.

Figure 4:
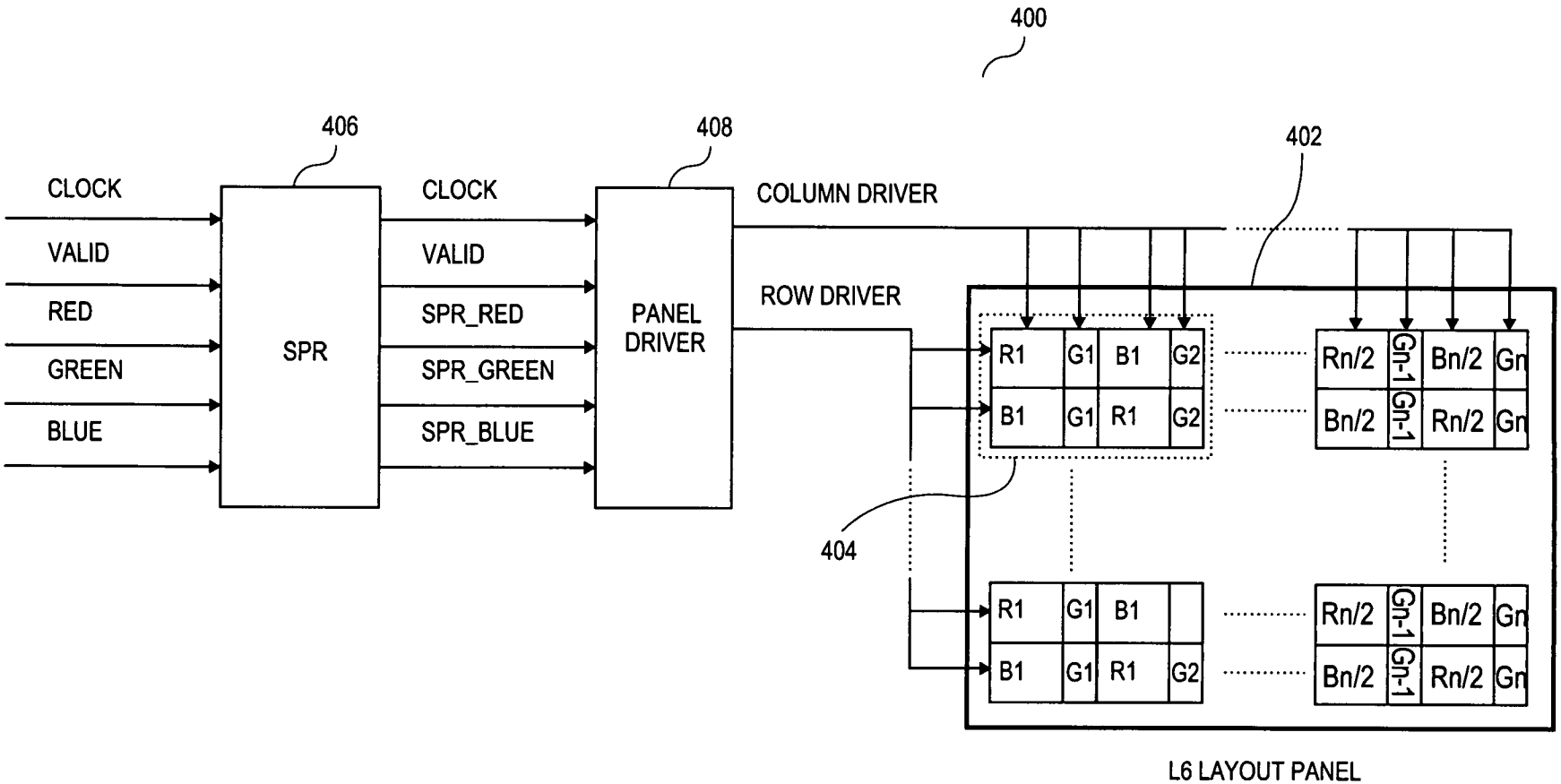
FIG. 4 is a high level block diagram of one embodiment of a video processing unit made in accordance with the principles of the present invention.

FIG. 4 shows a system 400 made in accordance with the principles of the present invention. Panel 402 comprises one of the plurality of novel subpixel repeat groupings 404 as disclosed in several of the herein incorporated patent applications. In this embodiment, the grouping 404 is a eight-subpixel repeating group comprising 4 green subpixels, 2 red subpixels and 2 blue subpixels—wherein the green subpixels may be of a reduced dimension as compared with red and blue subpixels and wherein the red and blue subpixels may be arranged in a "checkerboard" pattern. In this embodiment, it is possible to place a SPR block 406 before the panel driver 408. SPR block 406 could be implemented to accept a plurality of signals (e.g. clock, valid, red data, green data, blue data) and output another plurality of signals (e.g. clock, valid, red SPR data, green SPR data, and blue SPR data). These output signals could be input into panel driver 408 and written to the display via column and row drivers as shown.

It will be appreciated that the principles of the present invention apply to layouts other than the one shown in FIG. 4. In fact, the systems and techniques of driving subpixels and sending data to the display disclosed herein work as well on any panel having displays in which a given column (or more generally, along a same data/source line, if implemented in a row direction) has more than one color assignments. For example, FIG. 4 shows a panel in which the subpixel layout has certain columns that have red and blue image data that are applied to it. The present invention would work on any other display having other color assignments in a given column e.g. red and green—or any other colors (e.g. cyan, white, magenta or the like) that comprise the color assignments in a subpixel layout.

Figure 5:
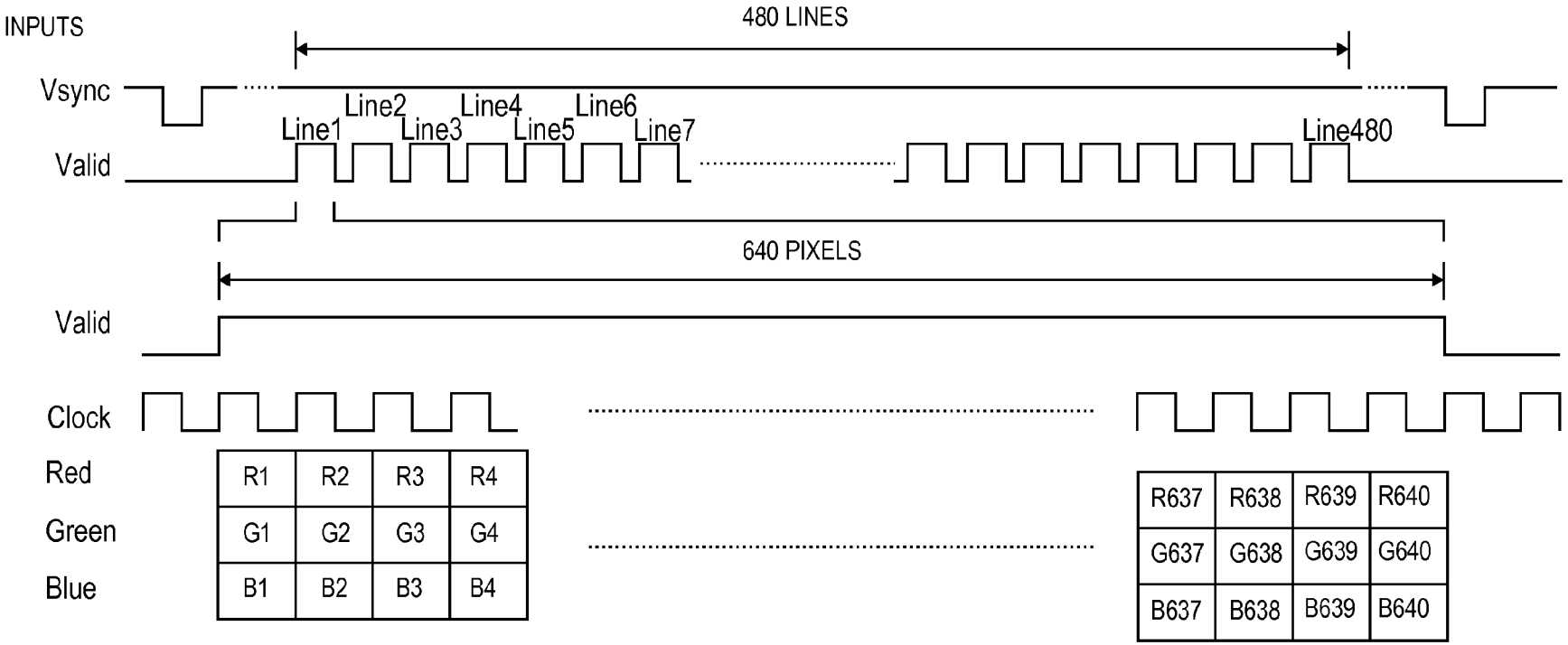
FIG. 5 (PRIOR ART)
FIG. 5 is one exemplar of an input data stream for a conventional RGB stripe system.

FIG. 5 shows one possible input signal diagram for an exemplary 640×480×3 display system, as might be used to drive the conventional display systems of FIG. 3. It should be noted that the red, green and blue data are typically input to the system in a parallel fashion a pixel at a time across an entire line. Of course, other input signal schemes are possible without departing from the scope of the present invention.

Figure 6:
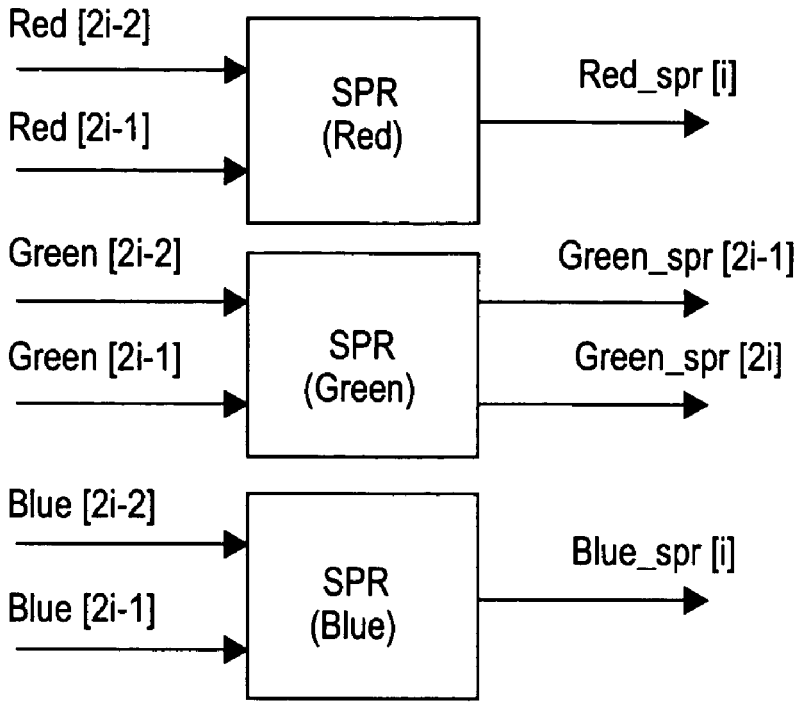
FIG. 6 is one embodiment of input image data and output image data mapping for a system made in accordance with the principles of the present invention.

For the conventional system of FIG. 3, the output image data is again 640×480×3; however, for novel systems disclosed herein and elsewhere in incorporated patent applications, the output image data may take different formats. For example, with the system of FIG. 4, the output red data could be one half the amount of the input red data, the output blue data could be one half of the amount of the input blue data and the green data output could equal the amount of the input green data. FIG. 6 depicts one embodiment of input/output image data from a SPR block for the red, green and blue data from a system such as shown in FIG. 4.

More generally, there might be a reduction of the number of image pixels, or subpixel data sets, from the input image set to the subpixel rendered image set—e.g. for the layout shown in FIG. 4 there is approximately a one third reduction in the number of pixels after SPR. It is now desirable to send the SPR image data to the panel drivers in an advantageous format to facilitate its ultimate rendering upon a panel. It will be appreciated that these techniques work for any other layout that has a reduced image set from the conventional RGB for the purposes of the present invention.

Figure 7:
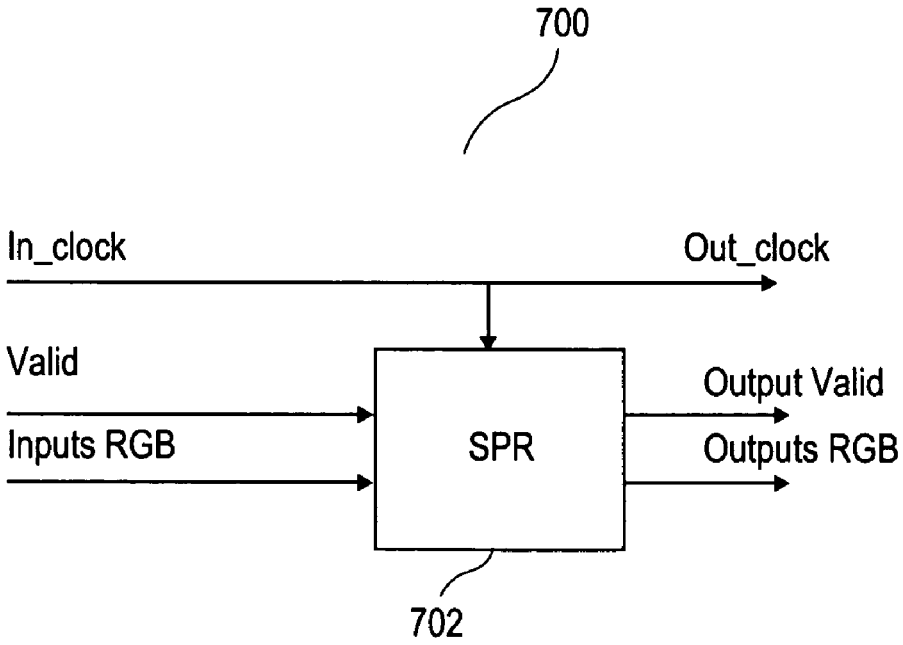
FIG. 7 is one embodiment of a synchronous SPR processing system made in accordance with the principles of the present invention.
Figure 8:
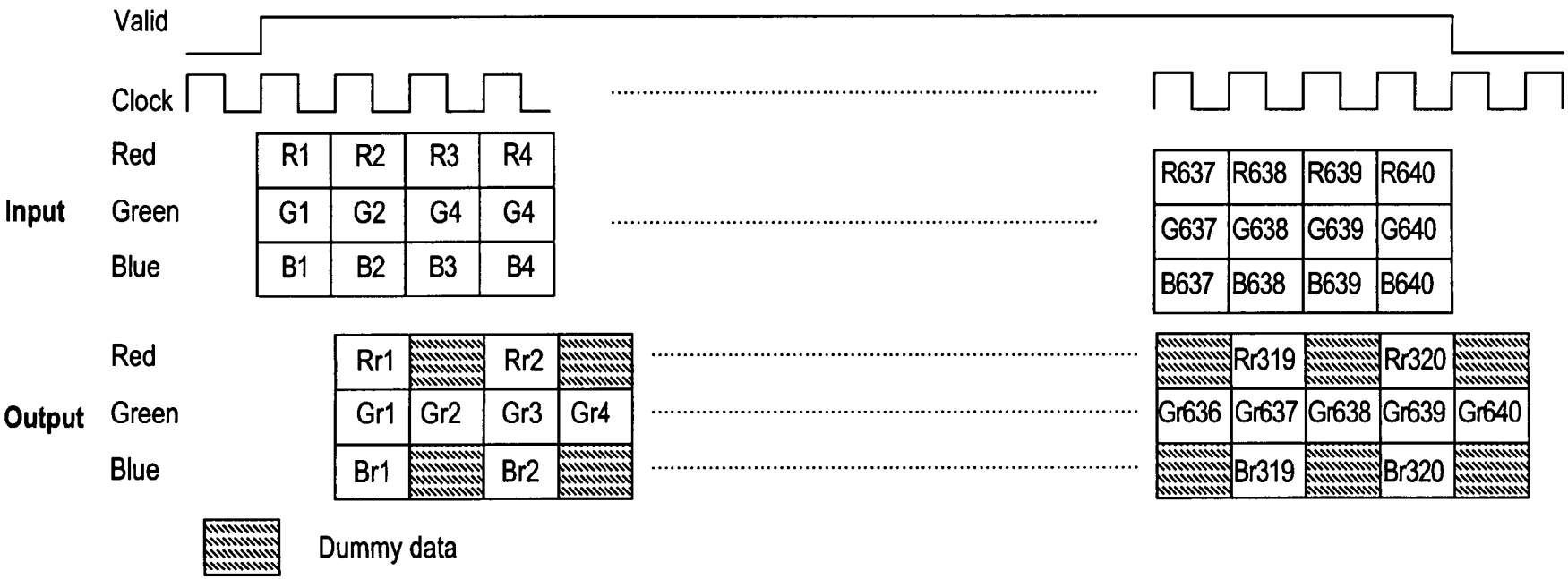
FIG. 8 is one embodiment of an input/output image data stream for the SPR processing system of FIG. 7.

One possible embodiment is to pad the SPR image data with dummy data into a new image data format. This would allow the input and the output cycle timing to remain unchanged. Additionally, it may not be necessary to use line memory in order to store the output image data. FIG. 7 shows one possible system embodiment 700 with this format. As shown, the input clock may be passed through as the same output clock for downstream use. The SPR block 702 would accept a Valid signal and Data signals and, after performing some image processing on the data, might send an Output Valid signal and an Output image data. The Output Valid signal could be coded in such a manner as to alert the panel driver or controller that certain data is dummy or valid image data to be rendered. FIG. 8 shows one possible timing diagram embodiment to effect the above image format embodiment. It will be appreciated that other image data formats comprising valid and dummy image data values are possible.

Figure 9:
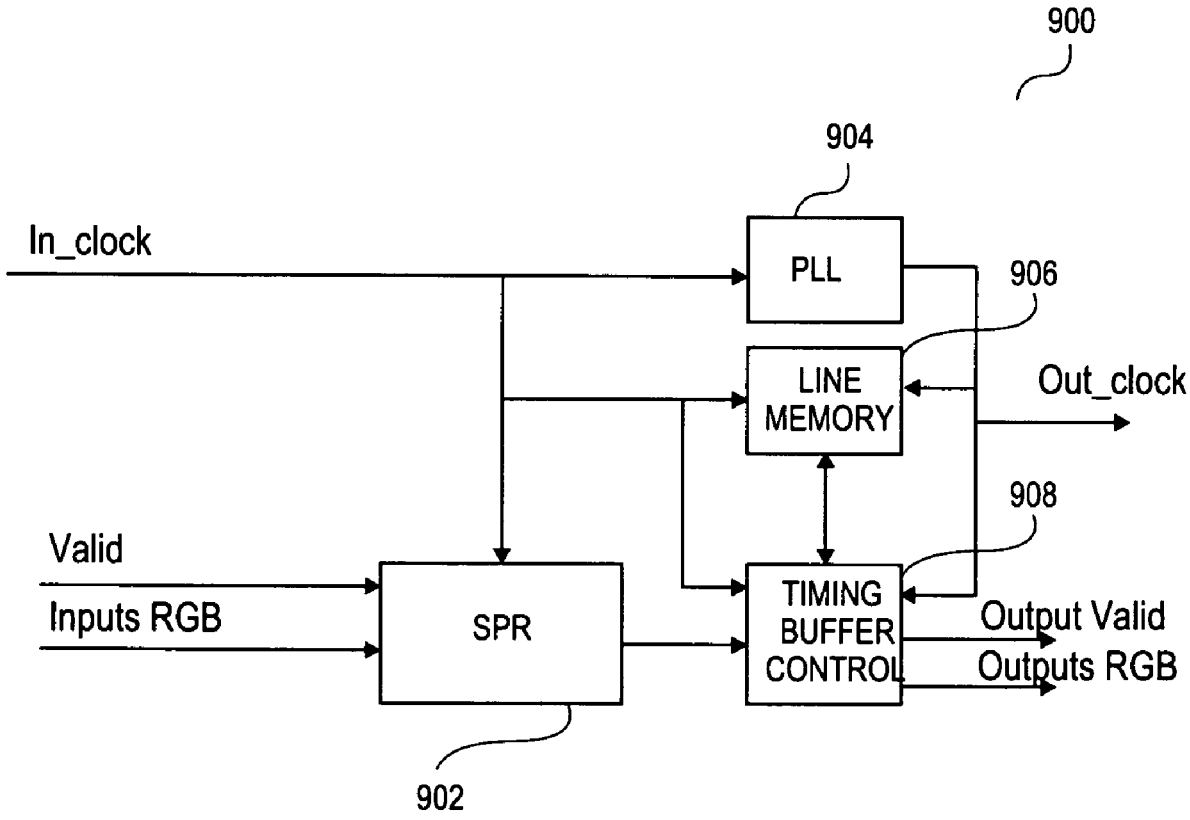
FIG. 9 is one embodiment of an SPR processing system made in accordance with the principles of the present invention.

Another possible embodiment is to pass along only valid image data to a panel driver—without the need for dummy image values. FIG. 9 depicts one possible system embodiment 900 that affects this result. SPR block 902 may accept a Valid signal and Data signals, as well as a Input Clock signal. Input Clock signal could also be supplied to other units—such as a phase locked loop (PLL) 904, line memory 906, and timing buffer control 908. The SPR image data could be output from SPR block 902 to timing control buffer 908 and/or line memory 906 (either directly or via a connection with buffer control 908 ). PLL 904 is providing an Output Clock signal, as needed to provide valid image data to the panel driver (possibly without need of dummy image data).

Figure 10:
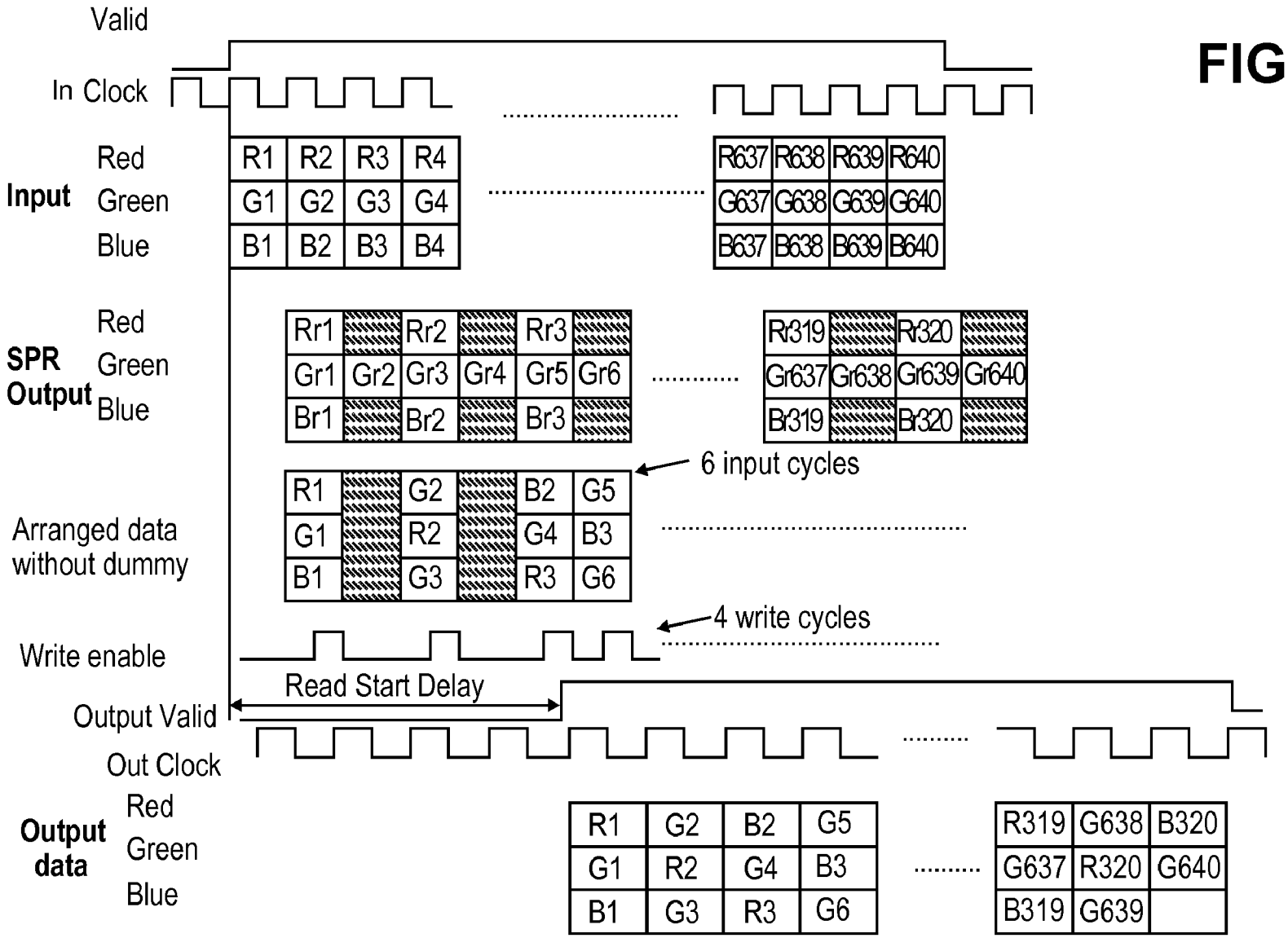
FIG. 10 is one embodiment of an input/output image data stream for the SPR processing system of FIG. 9.

FIG. 10 shows one possible timing diagram embodiment that effects this image format embodiment. In one embodiment, the output clock might be ⅔'s of the input clock signal. It will be appreciated that other clocking ratios might employed to implement other embodiments possibly having different subpixel layout repeating groups with its own output to input data ratios.

Figure 11:
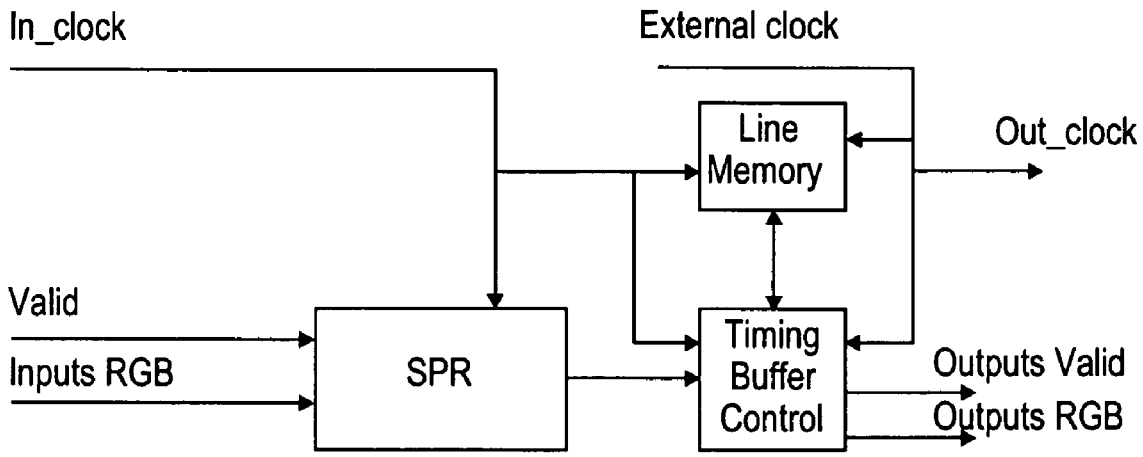
FIG. 11 is another embodiment of an SPR processing system made in accordance with the principles of the present invention.
Figure 12:
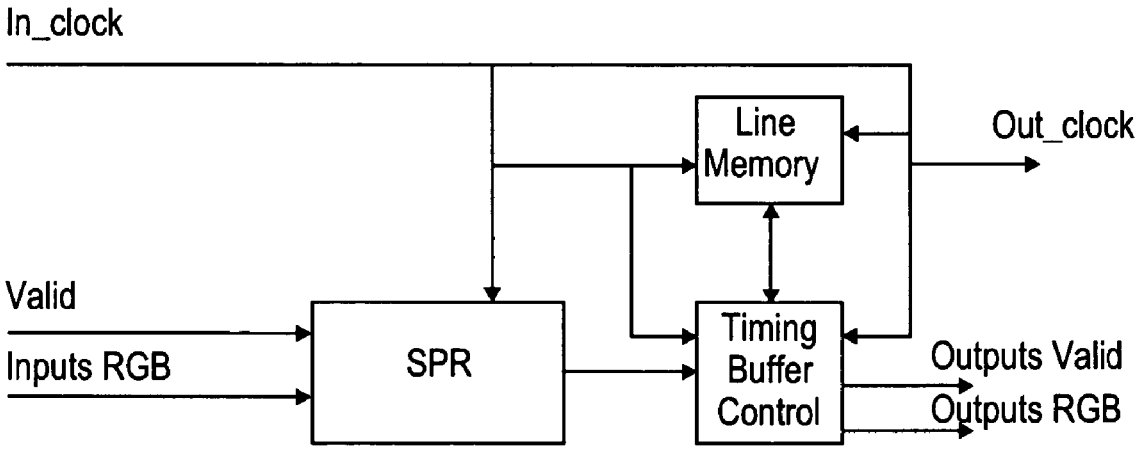
FIG. 12 is yet another embodiment of an SPR processing system made in accordance with the principles of the present invention.
Figure 13:
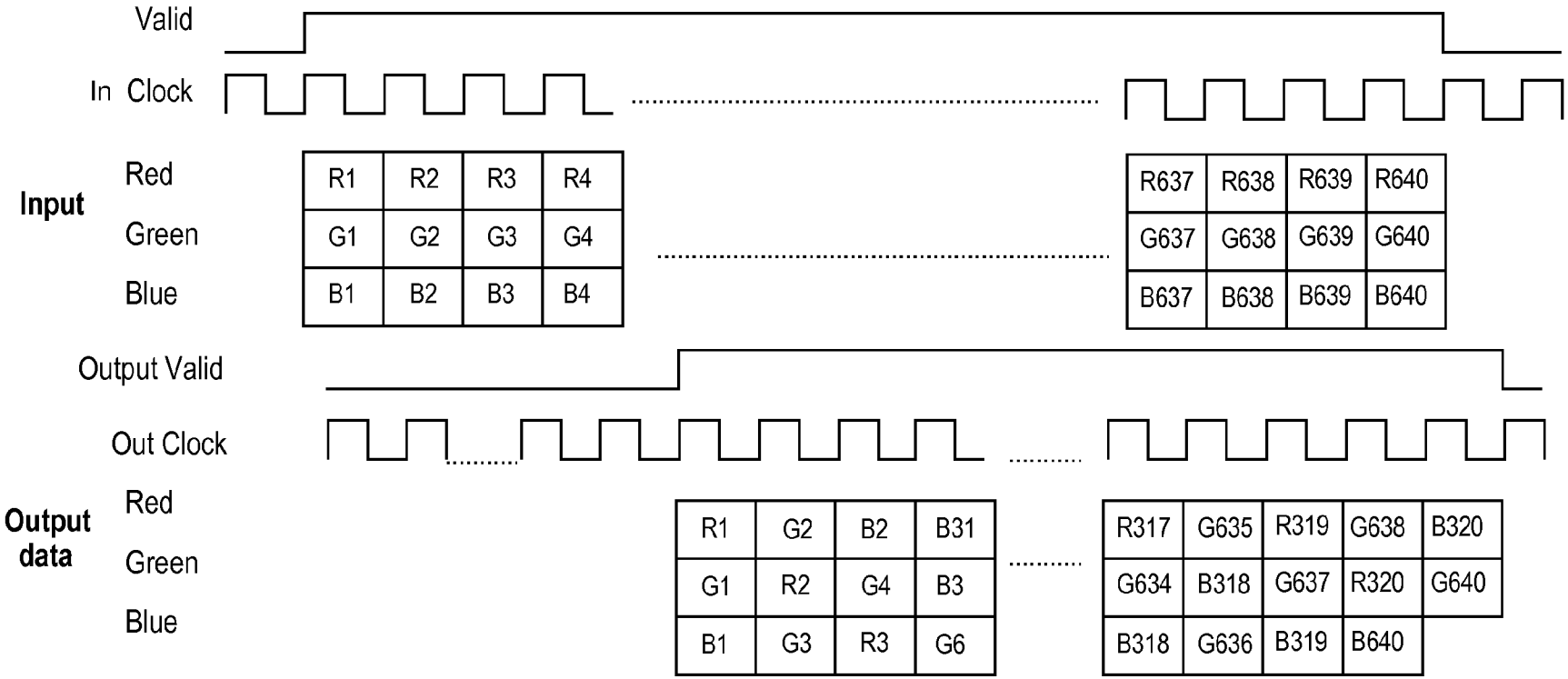
FIG. 13 is yet another input/output image data stream for an SPR processing system made in accordance with the principles of the present invention.

FIG. 11 depicts another embodiment of a system that passes along only valid image data to the panel driver without need of dummy image data. In this case, system 1100 employs an external clock, instead of using a PLL, for generating an output clock. FIG. 12 is yet another embodiment of a system that passes along only valid image data to the panel driver. In this case, the input clock signal is passed along as the output clock signal. FIG. 13 is an example of a timing diagram that might be suitable for the systems shown in FIG. 9, 11, or 12 ; but FIGS. 11 and 12 might have a different timing diagram based on a different output clock signal.

Figure 14:
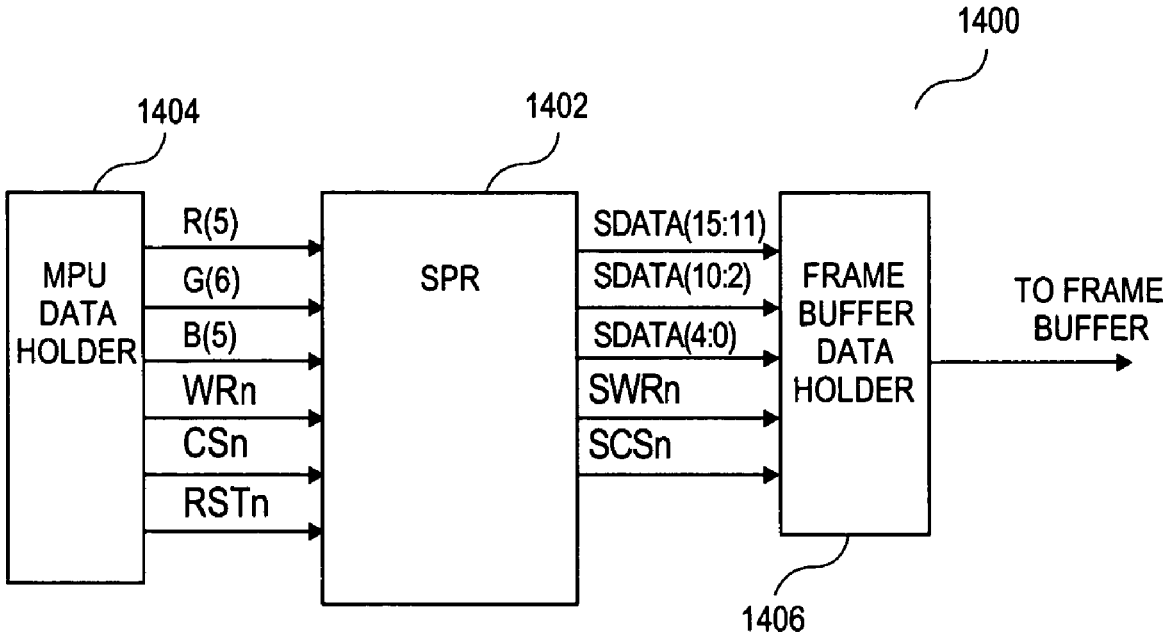
FIG. 14 is a block diagram of an SPR processing system for an MPU interface made in accordance with the principles of the present invention.
Figure 15:
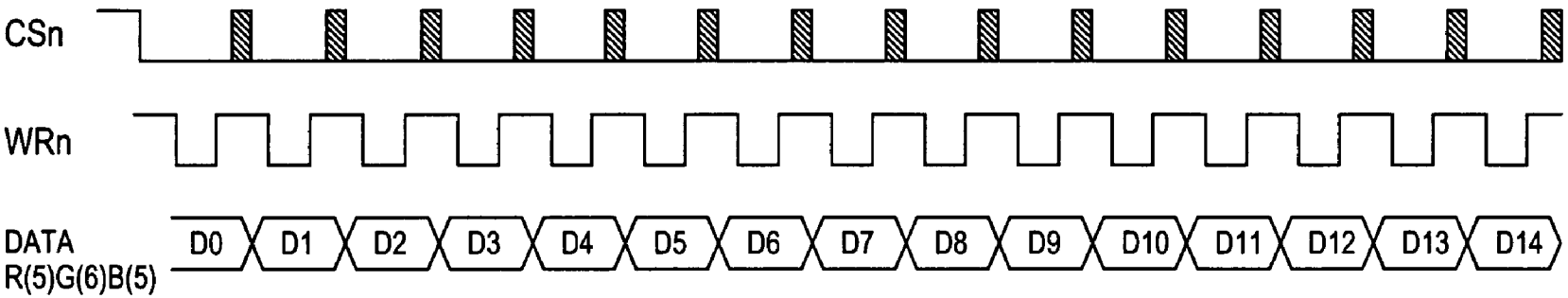
FIG. 15 is one example of a MPU interface input waveform.

FIG. 14 depicts a system 1400 that provides image data asynchronously to the rest of the image pipeline. SPR block 1402 accepts signals from a microprocessing unit (MPU)—either directly or via a buffer, cache or storage 1404. This data is passed along to SPR unit which, after desired processing, may be passed along to panel driver—either directly or to a frame buffer data storage 1406. This asynchronous design might be implemented with combination logics and, possibly with some input data latches (employing WRn as clock signal). FIG. 15 depicts one possible signal input to the SPR block from the MPU.

Figure 16:
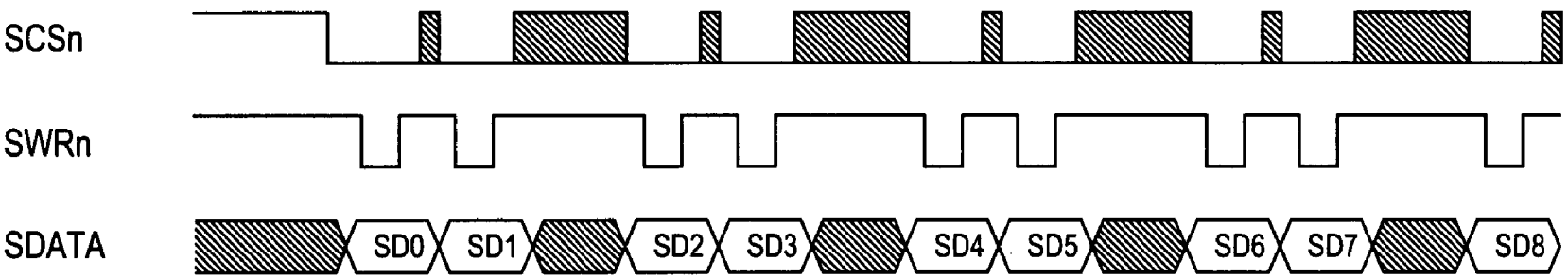
FIG. 16 is one example of a MPU interface output waveform.

With respect to a panel having the subpixel layout 404 (as shown in FIG. 4), the input could be received as a 16-bit signal—5 for red, 6 for green and 5 for blue. CSn depicts a chip select signal; WRn depicts a write signal; and RSTn depicts a reset signal from the MPU. FIG. 15 depicts an exemplary set of such MPU signals. After SPR processing, one possible set of output signals could be SDATA in a 5/6/5 bit format, SWRn as a write signal; and SCSn as a chip select signal from the SPR block. FIG. 16 depicts an exemplary set of such SPR signals. It will be appreciate that other embodiments are possible to include: 6-bit R, 6-bit G, 6-bit B data as well as 8-bit R, 8-bit G, 8-bit B data, among others.

The following data below depicts two possible cases for data format and timing.

TABLE 1

| SPR output format: |
|---|
| 16-bit R(5)G(6)B(5) data from MPU data holder might be transferred to display layout as the following:<br>SPR output data with layout format:<br>(SR0,G0,SB0,G1)<br>(SR1,G2,SB1,G3)<br>(SR2,G4,SB2,G5)<br>(SR3,G6,SB3,G7)<br>(SR4,G8,SB4,G9)<br>(SR5,G10,SB5,G11)<br>. . .<br>However, it might be desirable to align to 5-bit/6-bit/5-bit format before sending to frame buffer data holder.<br>SPR output data send to frame buffer data holder with (5-bit/6-bit/5-bit) format:<br>SD0: (SR0,G0,SB0)<br>SD1: (G1,SR1,G2)<br>SD2: (SB1,G3,SR2)<br>SD3: (G4,SB2,G5)<br>SD4: (SR3,G6,SB3)<br>SD5: (G7,SR4,G8)<br>SD6: (SB4,G9,SR5)<br>SD7: (G10,SB5,G11) |

There are two possible cases to consider for implementing these asynchronous systems:

Case 1: Output Pattern Sequence

FIG. 17 shows a possible output pattern sequence. As an example, the layout 404 of FIG. 4 is assumed at 128×128 pixel density. This output pattern sequence may be repeated in every six rows. This pattern sequence works at number of column =6*X+2 (e.g. 128, 320 . . . ) where the row are numbered by 6n, 6n+1, 6n+2, 6n+3, 6n+4, 6n+5 (n=0,1, 2 . . . )

Output patterns may be as follows:

SEL[1:0]:00 output R(5)G(6)B(5)

SEL[1:0]:01 output G(5)R(6)G(5)

SEL[1:0]:10 output B(5)G(6)R(5)

SEL[1:0]:11 output G(5)B(6)G(5)

New Patterns May Be Inserted As:

R(5)G(6)R(5): at boundary of row 6n+1 to the next row.

B(5)G(6)B(5): at boundary of row 6n+4 to the next row.

Figure 18:
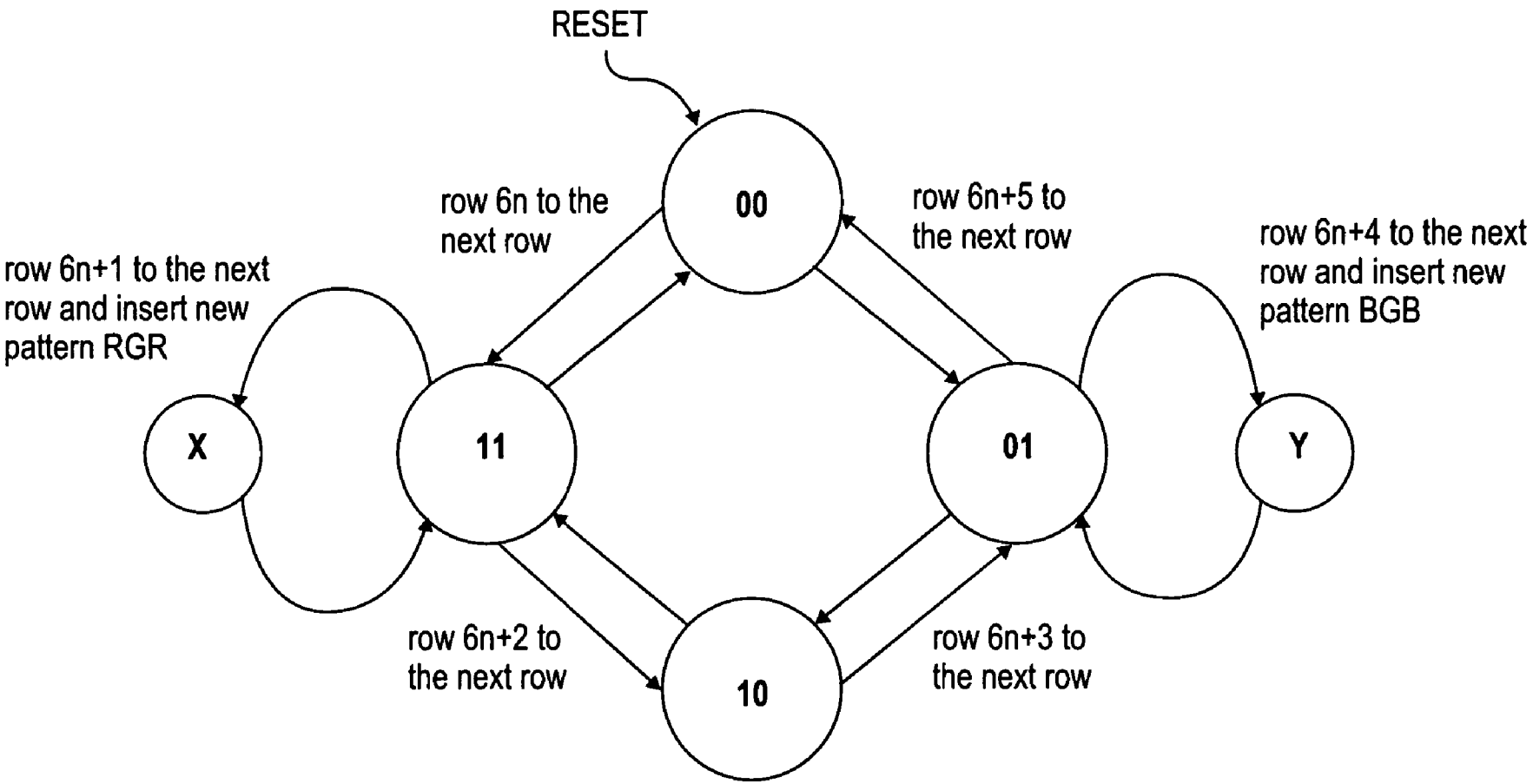
FIG. 18 is one example of a possible state machine implementation made in accordance with the principles of the present invention.
Figure 19:
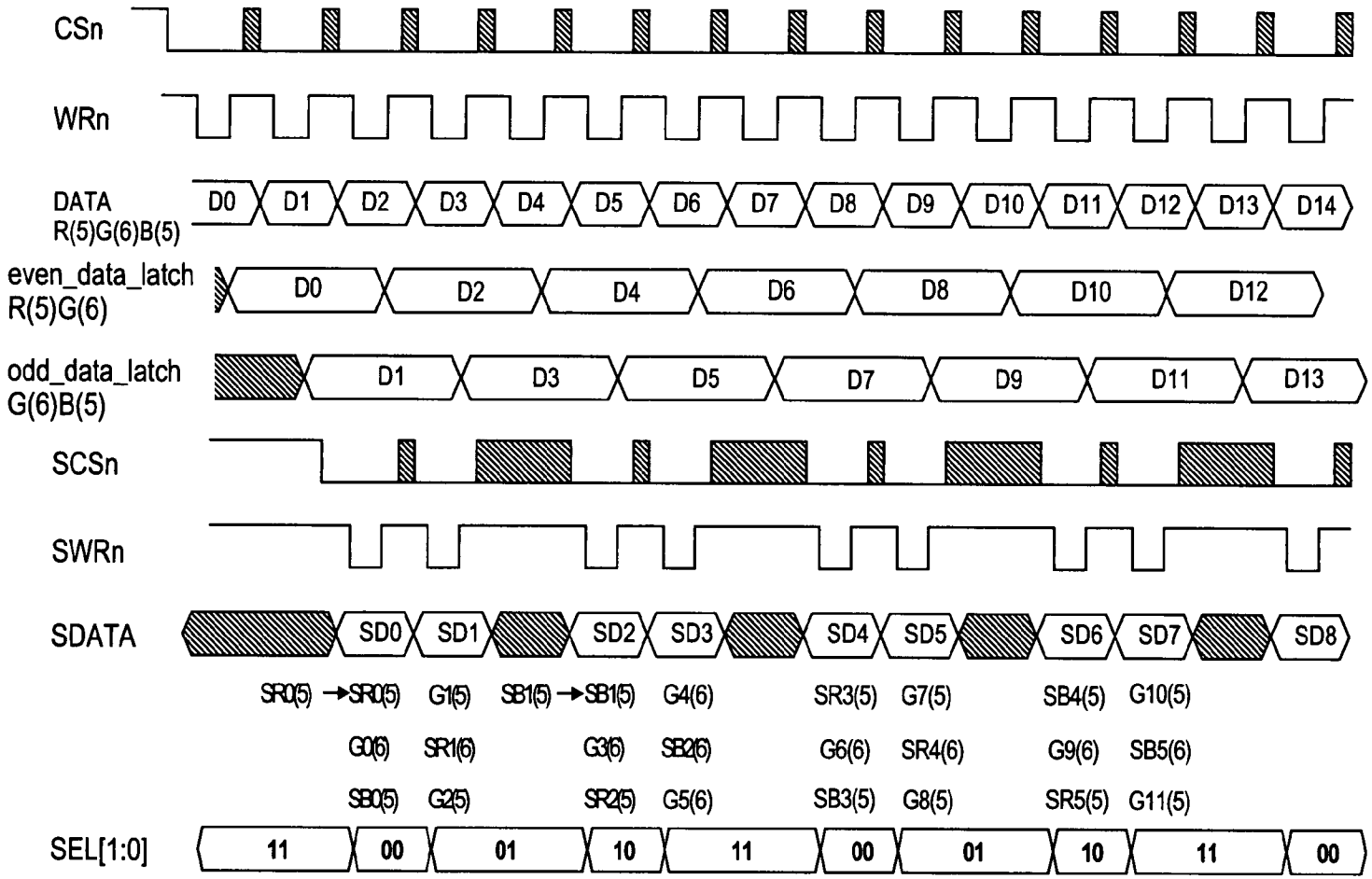
FIG. 19 is one example of a timing diagram of one possible embodiment

FIG. 18 depicts one possible state machine implementation of SEL[1:0]. FIG. 19 is one possible timing diagram of Case 1.

Case 2: Output Three Rendering Sub-pixels Each Time

Figure 20:
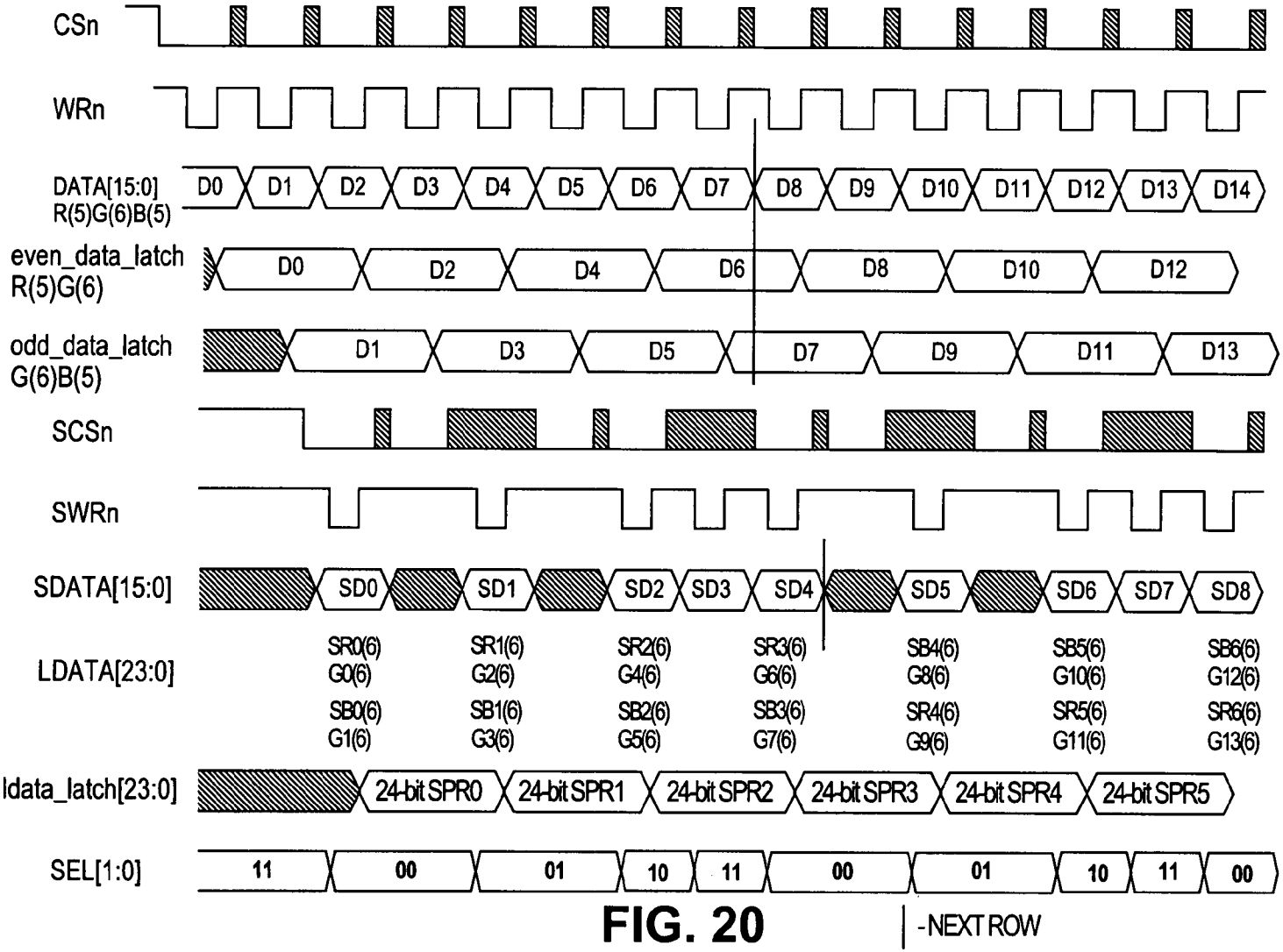
FIG. 20 is another example of a timing diagram.

In case 1, it may be difficult to implement a complex state machine for the asynchronous design. Additionally, the output pattern sequence may be different if the numbers of column are not covered by formula 6*X+2. Instead, it may be possible not to deal with output pattern sequence and inserting new pattern at boundary of two rows. Alternatively, it may be possible to have a suitable layout (e.g. RGBG) format ready then output three rendering sub-pixels each time. A 24-bit latch may be desirable for keeping RGBG data with 6-bit format each. Additionally, the write signal SWRn may be different from case 1. FIG. 20 depicts a one possible timing diagram for Case 2.

Output patterns: (ldata_latch here means previous LDATA)

SEL[1:0]:00 output {LDATA[23:19],LDATA[17:12], LDATA[11:7]}

SEL[1:0]:01 output {ldata_latch[5:1],LDATA[23:18], LDATA[17:13]}

SEL[1:0]:10 output {ldata_latch[11:7],data_latch[5:0], LDATA[23:19]}

SEL[1:0]:11 output {ldata_latch[17:13],ldata_latch[11:6], ldata_latch[5:1]}

Figure 21:
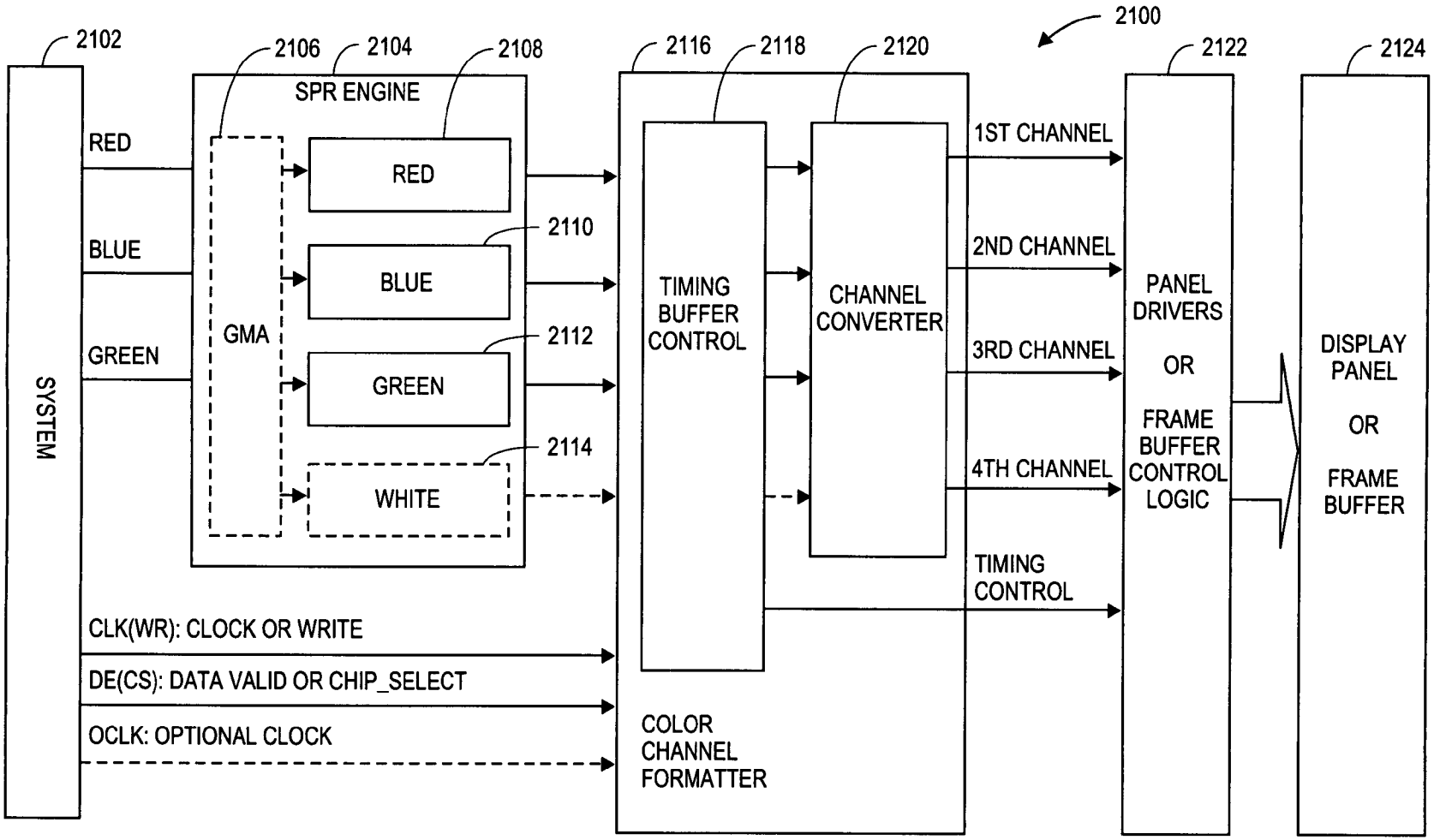
FIG. 21 is one example of an architecture which may support, by itself or variations of it, a variety of data formats and layouts.

FIG. 21 depicts a general architecture 2100 for the may optionally comprise (by itself or some subset of components thereof) multiple channels output to panel drivers or controllers. Input data arrives from system at 2102 and is typically (but not always) in 3-color space (e.g. RGB or some other suitable color space). SPR engine 2104 may optionally have a gamut mapping unit (GMA) 2106 to map the input color space into another color space that is suited to the display panel itself (e.g. RGB to RGBW or some other multi-primary color space). After optional gamut mapping, the image data may be subpixel rendered into whatever appropriate number of color planes (e.g. red 2108, blue 2110, green 2112, white (or some other color, if 4-, 5-, n- color planes are needed) ), to meet the display panel. Subpixel rendered data may then be sent to a color channel formatter 2116, which might comprises a timing buffer control 2118 (if needed) and a channel converter 2120. Channel converter 2120 may then employ a plurality of channels as needed (e.g. 4 channels as depicted in FIG. 21; but n channels are possible, n greater than or equal to 3). These channels output data in its unique format to the panel drivers or a frame buffer 2122 which is ultimately send on to the display panel.

The timing buffer block generates the output interface timing based on the input and output channel ratio. For the synchronous interface, a pixel clock (CLK), data valid (DE) and optional clock (OCLK) signals are used. For the asynchronous interface, Write and Chip Select (CS) are input to the color-channel formatter. With this output interface timing, the channel converter logic converts from SPR output formats to the panel driver interface formats, the array formats of panel driver or the frame-buffer interface formats, as shown in the FIG. 22.

FIG. 22 is a table of various possible embodiments of data or interface formats that might be implemented to serve panels comprising exemplary layouts as shown on the left. It will be appreciated that other unique subpixel layouts are possible and other choices for the number of channels and the data formats are also possible and contemplated with the scope of the present invention.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A system for rendering input image data formatted for a first colored subpixel layout onto a display panel comprising a second colored subpixel layout comprising a repeating group of colored subpixels and wherein said first subpixel layout is different from some of said second subpixel layout, said system comprising:

an input means for accepting input image data formatted for said first colored subpixel layout;

a subpixel rendering engine for remapping the input image data into output data formatted for said second colored subpixel layout;

a channel formatter for effectively ordering said output data such that a timing scheme is affected to map said input image data formatted for said first colored subpixel layout onto said output data formatted for said second colored subpixel layout; and a means for outputting the data formatted by said channel formatter to said display panel, wherein said subpixel repeating group further comprises at least one column having more than one color.

2. The system of claim 1, wherein said system further comprises a gamut mapping system for remapping the image data in a first colored subpixel data format into said second colored subpixel data format wherein said first colored subpixel data comprises data in a first set of primary colors and said second colored subpixel data format comprises data in a second set of primary colors.

3. The system of claim 1, wherein the channel formatter formats said output data according to the number of channels available to the display controllers.

4. The system of claim 3, wherein the channel formatter adds dummy image data to the valid output data set.

* * * * *